US009011094B2

(12) United States Patent
McPeek et al.

(10) Patent No.: US 9,011,094 B2
(45) Date of Patent: Apr. 21, 2015

(54) FAN ASSEMBLY AND GAP TOOL

(75) Inventors: Mark J McPeek, Monroe, MI (US); Brian J Tarkowski, Richmond, IL (US); Sherman L Brewer, Eureka, IL (US); Venkata Subba Reddy Atluri, Pimpri (IN); Matthew Robert Espley, Brownstown, MI (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 475 days.

(21) Appl. No.: 13/495,651

(22) Filed: Jun. 13, 2012

(65) Prior Publication Data

US 2013/0336769 A1 Dec. 19, 2013

(51) Int. Cl.

| | |
|---|---|
| ***F04D 29/60*** | (2006.01) |
| ***F04D 29/62*** | (2006.01) |
| ***F04D 25/02*** | (2006.01) |
| ***F01P 5/04*** | (2006.01) |

(52) U.S. Cl.

CPC ..... *F04D 29/622* (2013.01); *F04D 25/02* (2013.01); *F04D 29/626* (2013.01); *F01P 5/04* (2013.01); *F01P 2070/50* (2013.01)

(58) Field of Classification Search

CPC ..... F04D 29/622

USPC ..... 415/121.3, 213.1; 29/889.3; 411/44, 55; 123/41.49

See application file for complete search history.

(56) References Cited

U.S. PATENT DOCUMENTS

| | | | | |
|---|---|---|---|---|
| 4,522,160 | A * | 6/1985 | Speers et al. | 123/41.49 |
| 5,275,538 | A * | 1/1994 | Paliwoda et al. | 417/314 |
| 5,722,477 | A * | 3/1998 | Richter et al. | 160/135 |
| 5,730,583 | A * | 3/1998 | Alizadeh | 416/189 |
| 7,090,467 | B2 | 8/2006 | Jenks | |
| 2005/0089397 | A1 * | 4/2005 | Quill et al. | 415/131 |
| 2006/0198714 | A1 * | 9/2006 | Lesecq | 411/44 |
| 2008/0247839 | A1 * | 10/2008 | Seegmiller | 411/44 |
| 2010/0111667 | A1 | 5/2010 | Stagg | |
| 2012/0042607 | A1 * | 2/2012 | Chauncey | 52/745.21 |
| 2013/0306006 | A1 * | 11/2013 | Mott et al. | 123/41.49 |

* cited by examiner

*Primary Examiner* — Liam McDowell

(74) *Attorney, Agent, or Firm* — Jeffrey P. Calfa; Mark C. Bach

(57) ABSTRACT

This is a system and apparatus for precisely mounting a ring shroud to a motor vehicle cooling system and engine. A cooling fan subassembly is mounted to an engine and ring shroud subassembly containing fan braces that are mounted to the engine via mounting brackets. A mounting gap tool is inserted through apertures in the ring shroud to prescribe the radial and axial clearance between the ring shroud and the cooling fan subassembly. Once the ring shroud and cooling fan assembly are aligned to predetermined specifications for clearance, the installer secures all the fasteners in the mounting brackets and retrieves any or all the mounting gap tools.

11 Claims, 12 Drawing Sheets

FAN ASSEMBLY AND GAP TOOL

BACKGROUND

Heavy transportation machinery including motor vehicles such as light-duty, medium-duty, and heavy-duty trucks for personal and commercial use, and off-highway equipment and vehicles are typically constructed and assembled via separate subassemblies. One such subassembly is the motor cooling system which includes a front or side mounted fan for certain operation requirements. An additional subassembly is the radiator and cooling assembly. Both of these subassemblies are intended to be mated such that the fan facilitates in drawing air through the radiator assembly for facilitating in the cooling of the engine. There are a variety of fans used in these types of applications such as axial-flow fans, radial-flow fans, mixed-flow fans and high-efficiency hybrid-flow fans. Additionally, in the radiator or cooling assembly, it is common to include a ring shroud or cowling that surrounds the fan and which is intended for increasing the fan efficiency and reducing the sound of the operation of the fan.

An integral feature of the manufacturing of these subassemblies including the ring shroud is the tolerances which must be observed in the manufacturing. In order to maximize the performance of the fan, sufficient efforts should be made to mount the ring shroud very precisely around the fan, that is, there must be consistent clearance or a gap around and in between the entire circumference of the fan outer ring and the ring shroud. Such tolerances must be carefully controlled in order to preserve the performance and reliability of the machine. Not only does the ring shroud facilitate in improving the efficiency of the fan, but the gap between the ring shroud and fan outer ring is necessary to avoid crash conditions between them. Since the fan subassembly is connected to the engine, movement of the engine results in relative movement of the fan subassembly relative to the ring shroud. Consequently, interference may exist which may damage the fan outer ring and the fan vanes, thus the importance of sufficient and consistent gap between the ring shroud and the fan outer ring.

Accordingly, there is a need to ensure that the fan subassembly is mounted accurately and precisely within the ring shroud during manufacturing utilizing a simple system which facilitates the ease of assembly for an installer during the manufacturing process and also requires limited parts to limit costs. The described embodiment is directed to overcoming problems triggered by the variation present in most large scale manufactured parts and associated with mounting the ring shroud with respect to the fan subassembly.

SUMMARY

Disclosed herein are embodiments of a cooling fan and gap tool. In one embodiment, a fan assembly and gap tool for motor vehicle cooling system comprises an engine, a fan motor, a cooling fan, at least three mounting brackets, a ring shroud, and at least three fan braces. The fan motor is mounted to the engine. The cooling fan is mounted to the fan motor. Each of the at least three fan braces is affixed to the ring shroud. Each of the at least three mounting brackets has one end and an opposite end. Each of the at least three mounting brackets is mounted to the engine at the one end and is loosely mounted to one of the at least three fan braces at the opposite end. A plurality of gap tools align the ring shroud to the cooling fan before securing the at least three mounting brackets to the at least three fan braces.

Another embodiment provides a gap tool for mounting a ring shroud to a cooling fan assembly in a motor vehicle. In this embodiment, the gap tool comprises a head, an elongated cylinder having one end and an opposite end, a shoulder stop and at least one resilient arm. The head is connected to the one end of the elongated cylinder. The elongated cylinder has a beveled finish at the opposite end. The shoulder stop is attached to the elongated cylinder in a planar configuration with the head. The at least one resilient arm is attached to the elongated cylinder and gradually and continuously diverges outwardly from the opposite end of the elongated cylinder.

DETAILED DESCRIPTION

Figure 1E:
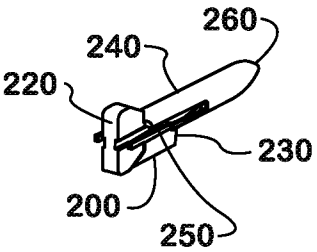
FIG. 1E is a perspective view of the gap tool of FIG. 1A

Embodiments of a fan assembly and a gap tool are disclosed. One embodiment comprises a system for mounting a ring shroud to a motor vehicle cooling system and engine. This system comprises of an engine that supports a fan subassembly having a fan motor, a cooling fan that is mounted to the fan motor which is propelled by the engine. The cooling fan member has a fan hub and a plurality of fan vanes extending outwardly from the fan hub. The fan vanes sit in between a fan circumferential ring and a fan outer ring. The fan circumferential ring is attached to the fan vanes and it surrounds the fan hub, the fan circumferential ring member has a disc shape extending radially. The fan outer ring has an annular shape and is attached to the tips of the fan vanes. The fan subassembly is partially covered by a ring shroud mounted in front of the fan outer ring. The ring shroud comprises of an annular shaped ring shroud base, a fan rubber seal, and mounting hardware such as ring inlets or fan braces. The ring shroud base has perforations to allow the insertion of a mounting or gap tool during assembly or subassembly.

In another embodiment, the assembly of the ring shroud to the fan subassembly involves the engagement of several mounting brackets between the engine and the ring shroud and the use of a plurality of gap tools. After the cooling fan subassembly has been installed, the method of assembly of the ring shroud to the cooling fan assembly entails installing mounting brackets to the engine, followed by tightening the fasteners in the mounting brackets at the engine end but leaving the fasteners loose at the opposite end. The ring shroud mounting hardware or braces may have oversized holes that would allow for any necessary adjustments during the ring shroud placement. The ring shroud is mounted against the free end of mounting brackets that were previously mounted to the engine at the opposite end. While the fasteners in the ring shroud end are still loose, the gap tools are inserted through apertures in the pre-perforated ring shroud base.

In some embodiments, the gap tool facilitates the aligning of the ring shroud against the fan outer ring by providing static conditions and defining precisely the radial and axial gap between the interior of the ring shroud base and the exterior of the fan outer ring. Several gap tools may be inserted through the pre-perforated ring shroud base. The head of the gap tool acts a stopper restricting how far the gap tool will penetrate once inserted through the ring shroud base aperture. The shoulder stop of the gap tool defines the axial gap between the interior of the ring shroud base and the exterior fan outer ring. The elongated cylinder body of the gap tool defines the radial gap between the interior of the ring shroud base and the exterior fan outer ring.

In an embodiment of the gap tool, at least two resilient arms are attached to the elongated cylinder body and extend outwardly from the beveled end tip. The resilient arms will be urged together during the gap tool positioning through the ring shroud aperture. Once completely inserted, the resilient arms return to a deployed configuration securing the gap tool in place while engaged between the ring shroud base and the fan outer ring. Once sufficient gap tools have been inserted, at least two clamping devices may be positioned temporarily at opposite ends to grip together the fan subassembly, including the ring shroud. At this point, the remaining loose fasteners within the mounting brackets engaged between the engine and the ring shroud end are tightened to secure the cooling fan assembly together. Once the fasteners are tightened, the ring shroud and fan assembly has been securely mounted. The clamping devices and the gap tools can then be removed. Each gap tool can be removed by urging the resilient arms together to reverse the previously deployed configuration into an un-deployed configuration. The un-deployed configuration allows the inserted section of the gap tool that passed through the ring shroud aperture to be removed and disengaged from the ring shroud and fan assembly.

Figure 1D:
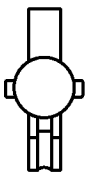
FIG. 1D is an end view taken along line B-B of FIG. 1A.
Figure 1A:
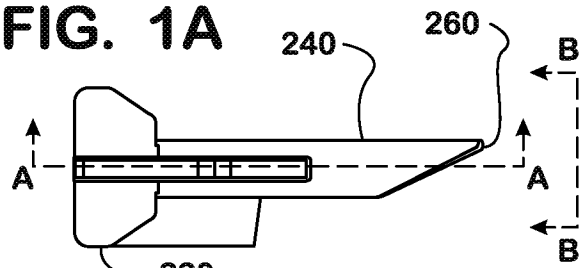
FIG. 1A is a side elevational view of gap tool disclosed herein.

FIG. 1A to FIG. 1E and FIG. 12 show an embodiment of the gap tool 200 for mounting a ring shroud 320 onto to a cooling fan 300 assembly. FIG. 1A shows a side view of the gap tool 200. FIG. 1A shows a tool shaped similar to a commercially available key having attached one resilient arm 250 coming out the side of its main body or elongated cylinder 240. FIG. 1A shows in one end of the gap tool 200, a head 220 in the shape of a key bow or a crest but it can be any shape as long as it is larger than the keyhole or aperture 210 in the perforated the ring shroud 320 and is large enough for a person's hand or machine to grip. Dimensionally, the head 220 has about twice the height (y-plane) when compared to its width (x-plane). The head 220, which is left protruding out of the ring shroud 320 when the gap tool 200 is in use, has a slope of about thirty-four degrees that rises (x-y plane) from the elongated cylinder 240 body on its upper side.

Attached to the head 220 in FIG. 1A is an elongated cylinder 240 that makes the main part of the gap tool 200 body and defines the radial gap 290 between the interior of the ring shroud 320 and the exterior of the fan outer ring 340. According to FIGS. 1A and 1B the length of the elongated cylinder 240 from the head 220 to the beveled tip 260 is about twice as long as the distance between the head 220 and the end of the shoulder stop 230 (x-plane). FIG. 1A shows at the end opposite to the head 220 a beveled tip 260 cut in about a twenty-two degree angle and rising from the x-plane.

FIG. 1A shows the shoulder stop 230. The shoulder stop 230 saliently comes out of the elongated cylinder 240 in the x-y plane. The shoulder stop 230 may be in a rectangle shape, its dimension defines the axial gap 280 between the interior of the ring shroud 320 and the exterior of the fan outer ring 340, and it is about half as long as the longest span of the elongated cylinder 240 starting from the end of the head 220 to the beveled tip 260.

Figure 1B:
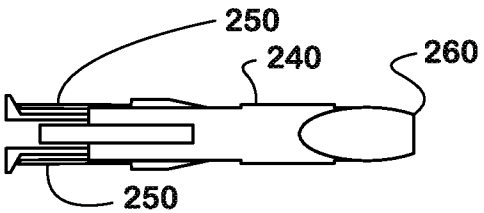
FIG. 1B is a side elevational view rotated 90 degrees from FIG. 1A.
Figure 1C:
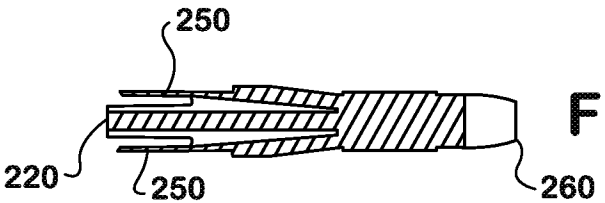
FIG. 1C is a sectional view taken along line A-A of FIG. 1A.

FIG. 1B and FIG. 1C show the two resilient arms 250 in a z-plane and being attached and parallel to the elongated cylinder 240 body. The two resilient arms 250 gradually and continuously diverge outwardly at about a three degree angle from the beveled tip end 260 of the elongated cylinder 240. The resilient arms 250 span to a length approximately half of the length of the gap tool 200 including the head 220 and the elongated cylinder 240 body. The resilient arms 250 are sufficiently resilient so that the resilient arms 250 can be urged or squeezed together into an un-deployed or closed configuration when pressure or force is applied. The resilient arms 250 should be capable of springing back to an open or deployed configuration once the pressure or force is removed.

FIG. 1D is an end view taken along line B-B of FIG. 1A. FIG. 1D shows the depth (z-plane) of the shoulder stop 230 being about half the size of the depth of the head 220. FIG. 1D, additionally the outward span of the resilient arms 250 are shown as slightly wider than the diameter of the elongated cylinder 240 body.

FIG. 1E is a perspective view of the gap tool of FIG. 1A having a head 220, a shoulder stop 230, a resilient arm 250 and an elongated cylinder 240 body with a beveled tip.

The gap tool 200 can be made of any thermoset polymer material, thermoplastic polymer material, metal, or wood among other materials. Depending on the material, the gap tool 200 can be manufactured by injection molding, extrusion, casting, or spin casting among other methods.

FIGS. 2 to 18 shows the gap tool 200 for mounting a high efficiency hybrid fan to a 15 L engine but the embodiment and utility of the gap tool is not limited to high efficiency hybrid fan systems or to 15 L engines as it could be useful on any type of cooling system for a motor vehicle engine that contains a shroud or cowling part mounted to a fan assembly.

The cooling fan 300 system in the embodiment shown in FIGS. 2-3 and FIGS. 6-11 has a fan hub 360, a fan circumferential ring 330 surrounding the fan hub 360, a plurality of fan vanes 310 that are positioned around the fan hub 360 and fan outer ring 340 connected to the ends of the fan vanes 310 members. The use of fan vanes 310 and rotating ring elements such as the fan circumferential ring 330 and the fan outer ring 340 to form a cooling fan 300 subassembly is well known in the art, and these fan subassemblies are commonly referred to as ring fans.

Figure 2:
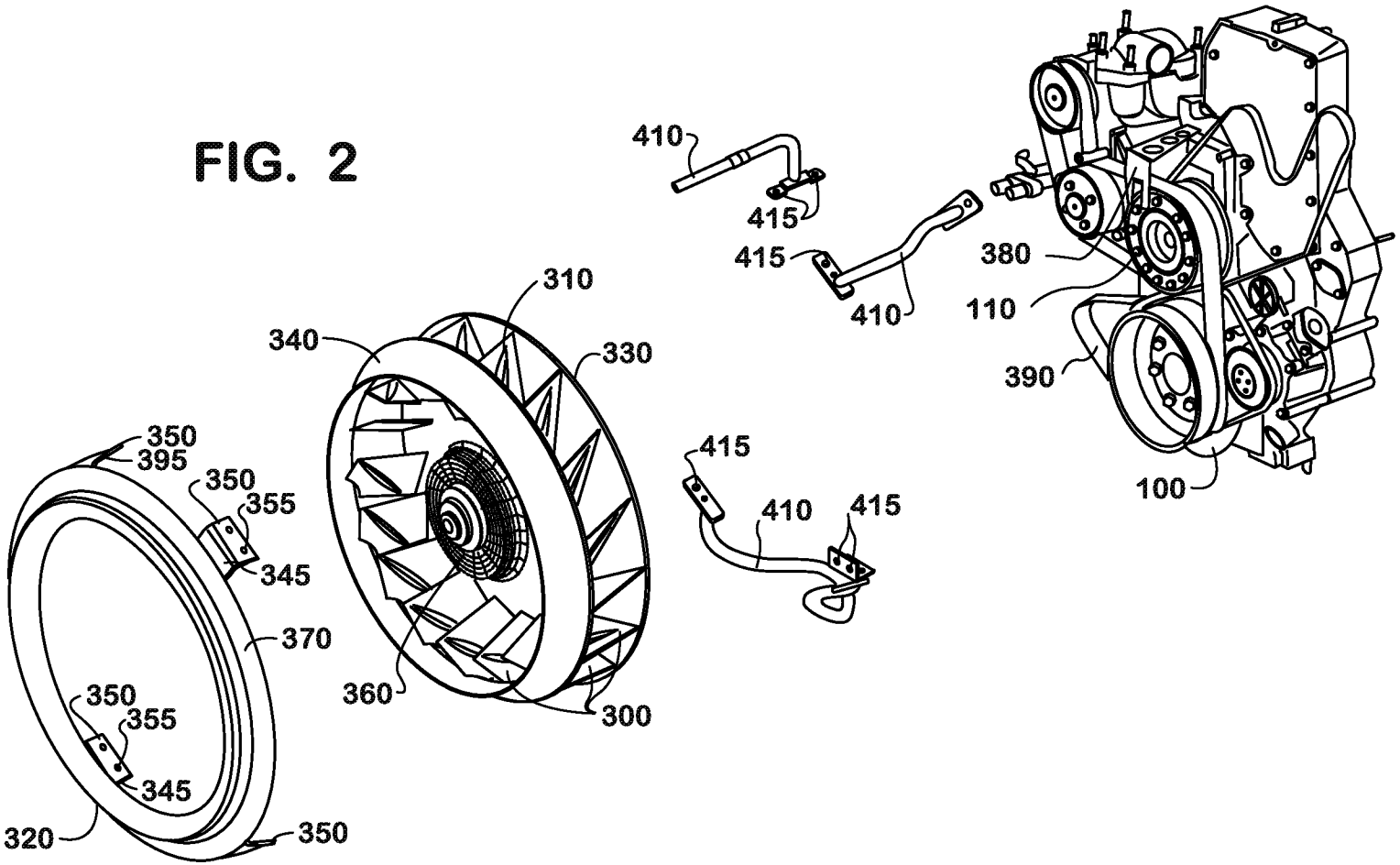
FIG. 2 shows an exploded view of a high efficiency hybrid fan and 15 liter engine.
Figure 3:
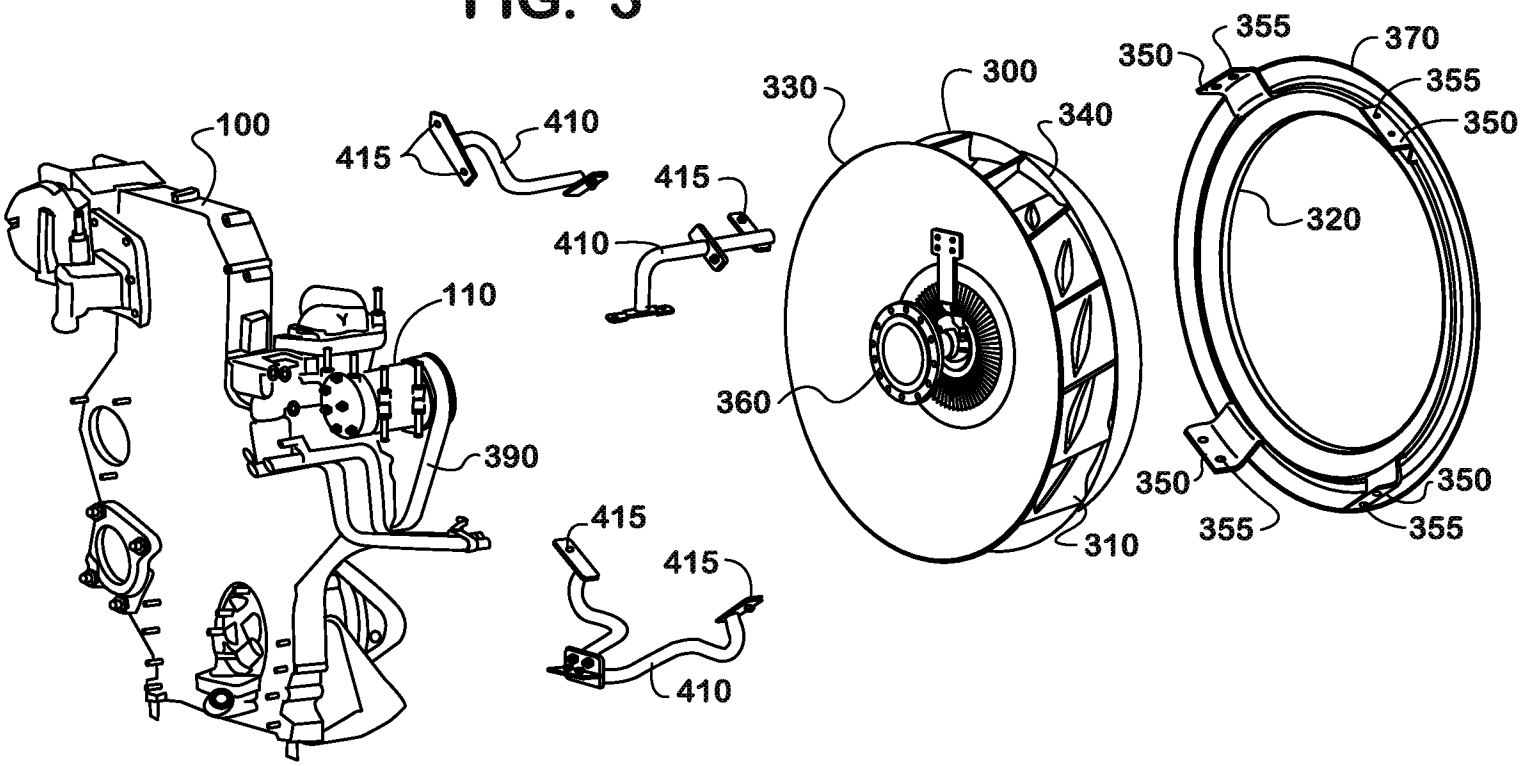
FIG. 3 shows an exploded view of a high efficiency hybrid fan and 15 liter engine (rear).

Although the embodiments of the fan circumferential ring 330 and the fan outer ring 340 shown in FIGS. 2-3 are solid, it is also possible that either one be discontinuous with gaps between the vanes or have openings in the ring itself, or that the ring member (or discontinuous portions thereof) can be positioned radially inwardly slightly from the ends of the fan vanes 310.

FIG. 2 and FIGS. 6-10 show a fan outer ring 340 that is intricately formed with the cooling fan 300 assembly and thus fixedly attached to the tips of the fan vanes 310. In accordance with an embodiment of the present invention, the fan outer ring 340 can also have a concave shape.

FIGS. 2-3, FIGS. 10-11, and FIGS. 15-17 show a ring shroud 320 having an annular shape. The ring shroud 320 has incorporated along its circumference four fan braces 350 that serve as its mounting hardware. The ring shroud 320 is to be positioned circumferentially around, or substantially circumferentially around, all or a principal portion of the rotating fan outer ring 340. FIGS. 2-3, FIGS. 10-11, FIGS. 13-18 show a fan rubber seal 370 surrounding the ring shroud 320. Although in the present embodiment the ring shroud 320 has four fan braces 350, it is possible to have less or more than four fan braces 350 for mounting a ring shroud 320 to a cooling system 300 assembly.

Figure 5:
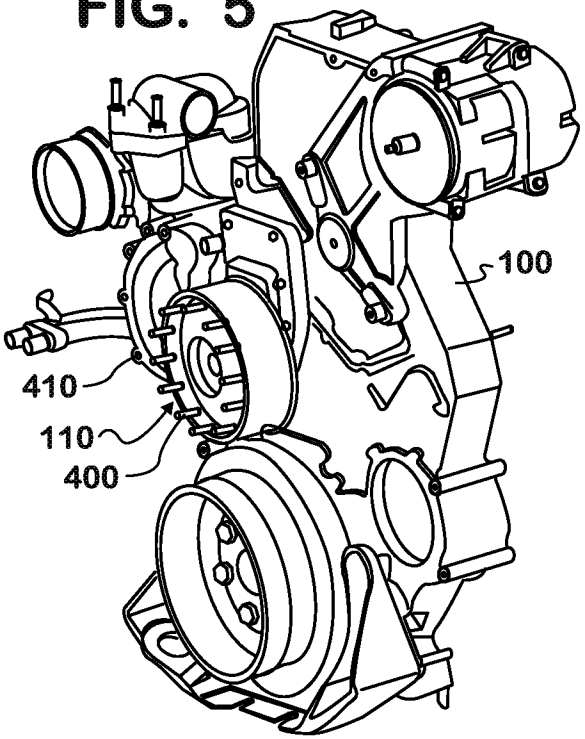
FIG. 5 shows a perspective view of a 15 Liter engine with fan motor.
Figure 4:
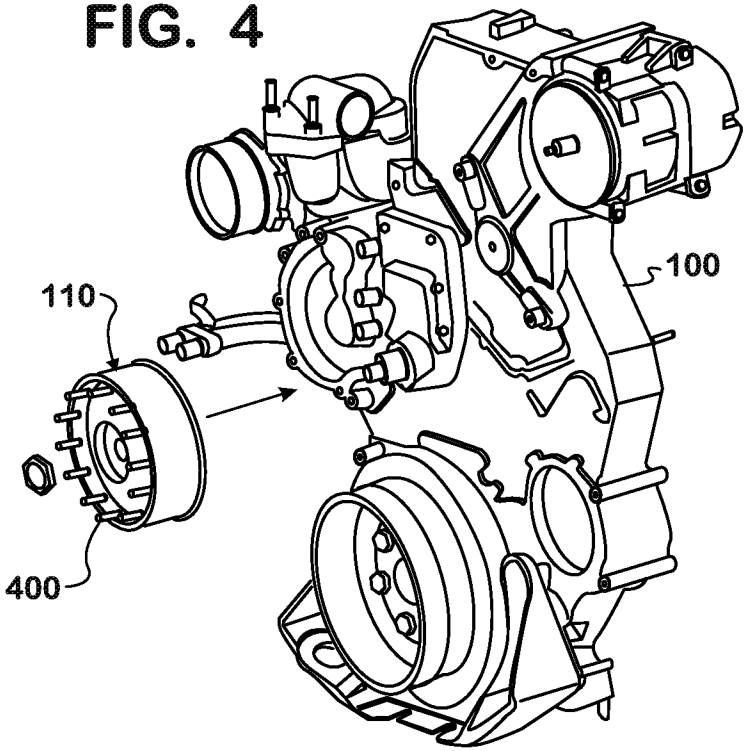
FIG. 4 shows an exploded view of a 15 Liter engine with fan motor.
Figure 6:
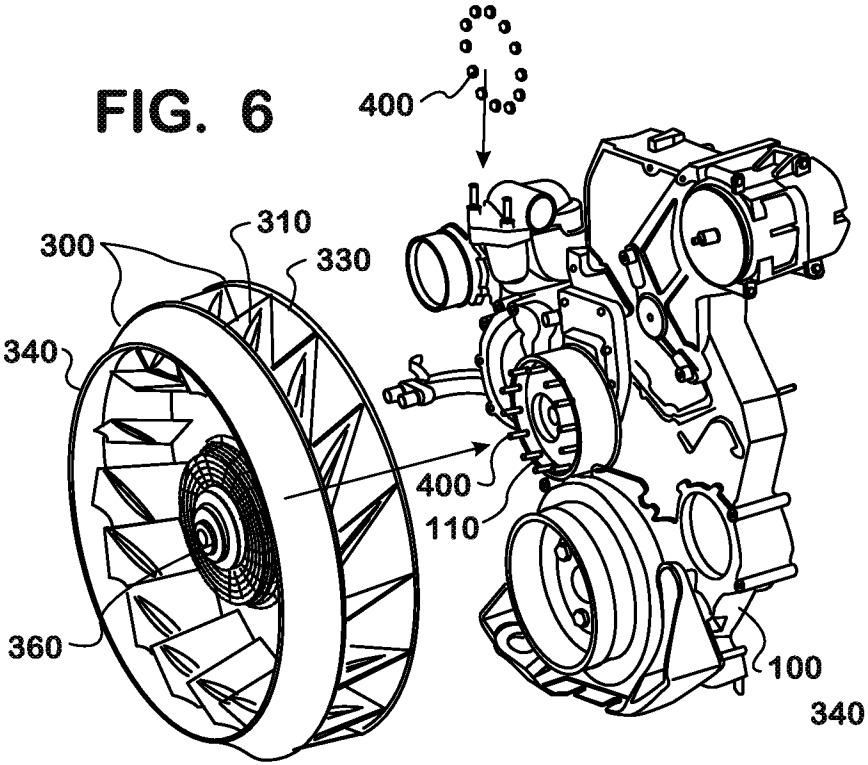
FIG. 6 shows an exploded view of a high efficiency hybrid fan, fan hub nuts, fan motor and 15 L engine.

The method of mounting the ring shroud 320 to the cooling fan 300 assembly using the described embodiment of the gap tool 200 begins by mounting the fan motor 110 to the engine 100 as shown in FIG. 4. Once the fan motor 110 is installed, as shown in FIG. 5, the shoulder portions of the shoulder nuts 400 are added. FIG. 6 shows a pre-assembled cooling fan 300 as it is being installed against the fan motor 110 and it is bolted in place with the use of the nut portion of the shoulder nuts 400.

Figure 7:
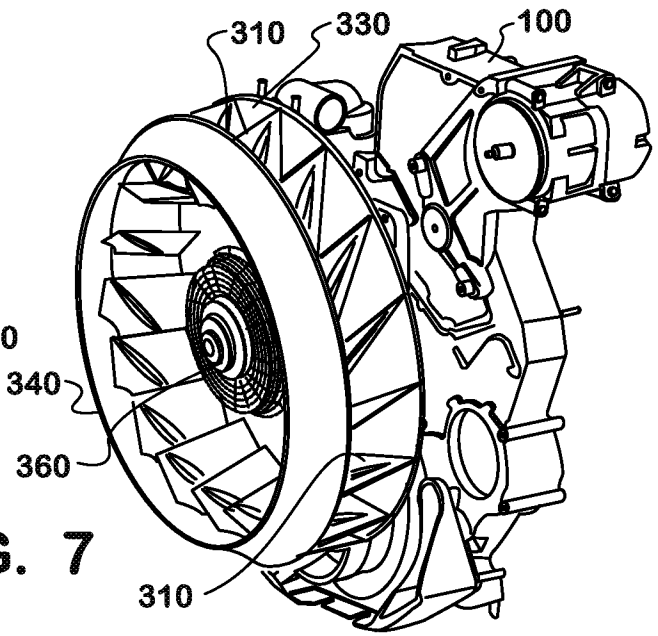
FIG. 7 shows a perspective view of a high efficiency hybrid fan and 15 L engine.
Figure 8:
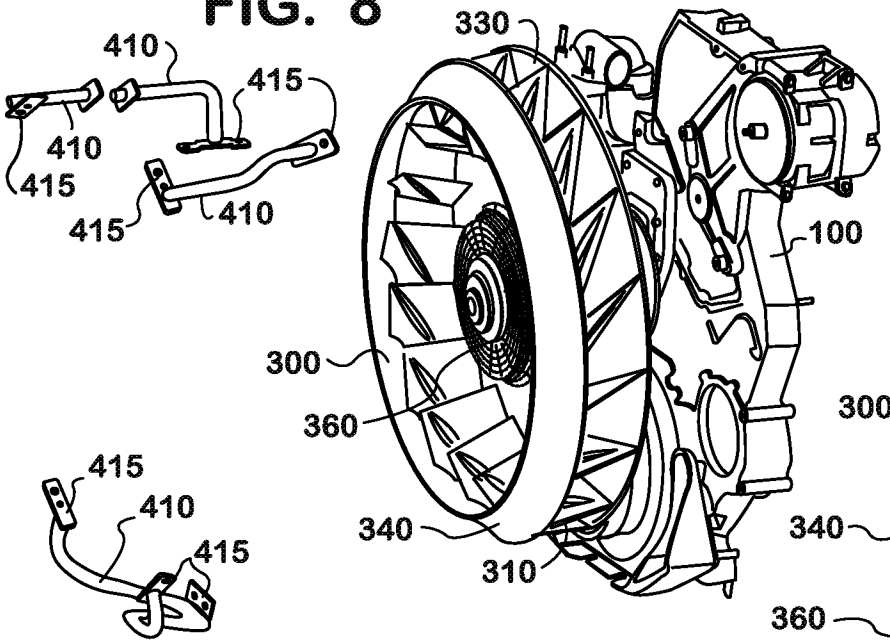
FIG. 8 shows an exploded view of a high efficiency hybrid fan, 15 L engine and mounting brackets.
Figure 9:
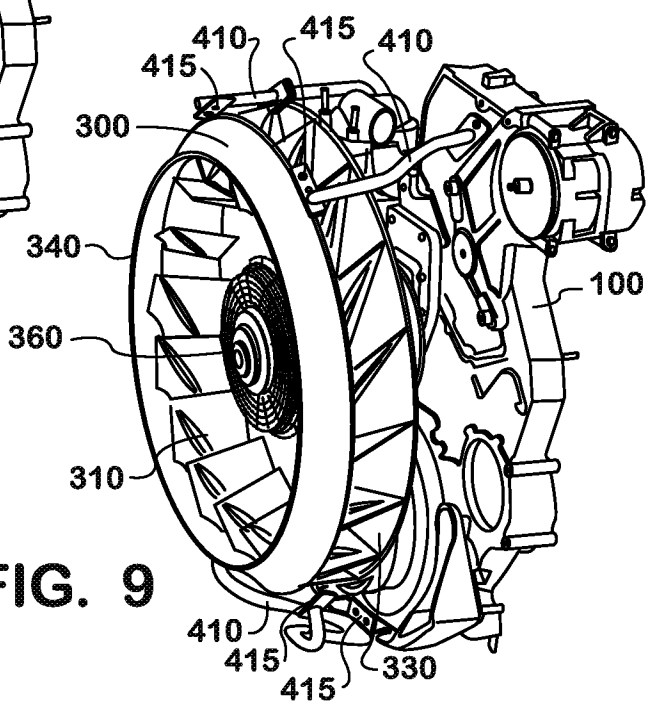
FIG. 9 shows a perspective view of a high efficiency hybrid fan, 15 L engine and mounting brackets.

FIG. 7 shows the cooling fan 300 installed on the engine 100. FIG. 8 shows mounting brackets 410 of a variety of shapes and sizes all having T-shape ends. In addition, FIG. 8 shows the cooling fan 300 and the engine 100 subassembly. FIG. 9 shows the mounting brackets 410 attached to different parts of the engine 100 at one end and not attached to anything at the opposite end with some fasteners 415 tightened and other fasteners 415 loose in preparation for subsequent subassembly steps.

Figure 10:
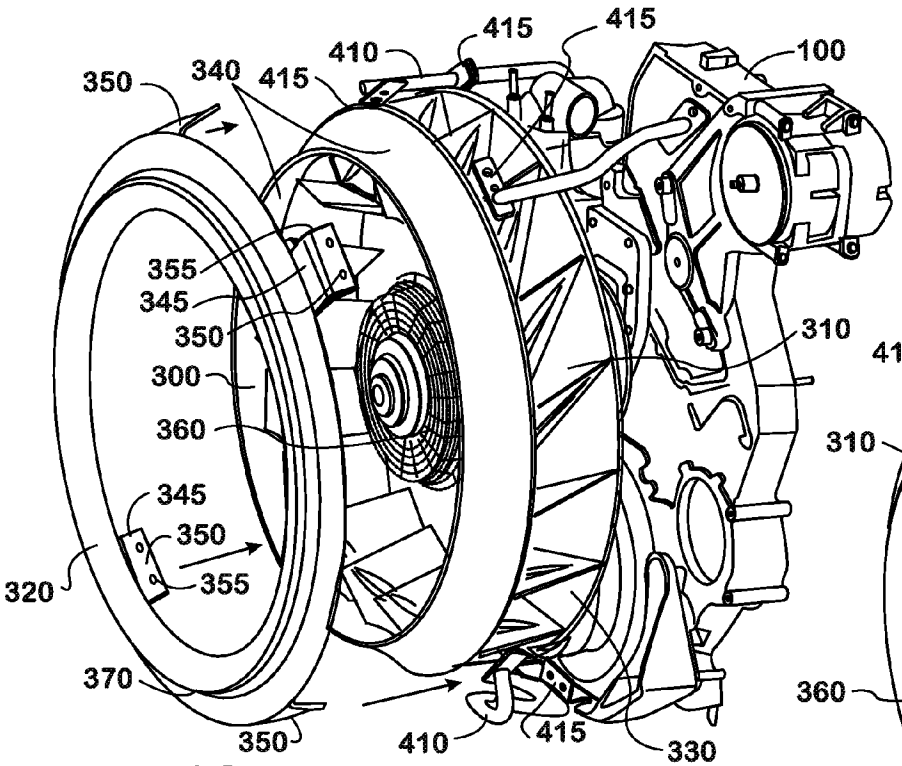
FIG. 10 shows an exploded view of the ring shroud, high efficiency hybrid fan, 15 L engine and mounting brackets.
Figure 11:
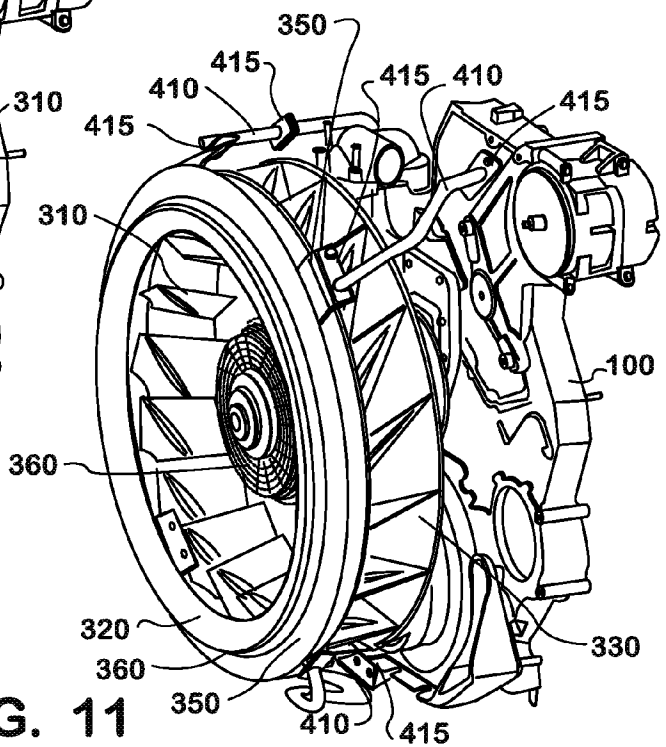
FIG. 11 shows a perspective view of partially assembled ring shroud, high efficiency hybrid fan, 15 L engine and mounting brackets.

FIG. 10 shows the engine 100, the cooling fan 300, the mounting brackets 410 and the ring shroud 320 with four fan braces 350, and a fan rubber seal 370 surrounding the ring shroud 320. Each fan brace 350 in FIGS. 2-3 and FIGS. 10-11 have a face plate 345 end with holes 355. The fan brace holes 355 may be oversized to allow for adjustments during assembly and are intended to be attached to mounting brackets 410 with the help of fasteners 415. FIG. 11 shows the ring shroud 320 subassembly mounted to the mounting brackets 410, the fasteners 415 of the mounting brackets 410 are tightened on the engine 100 side only.

Figures 12, 13:
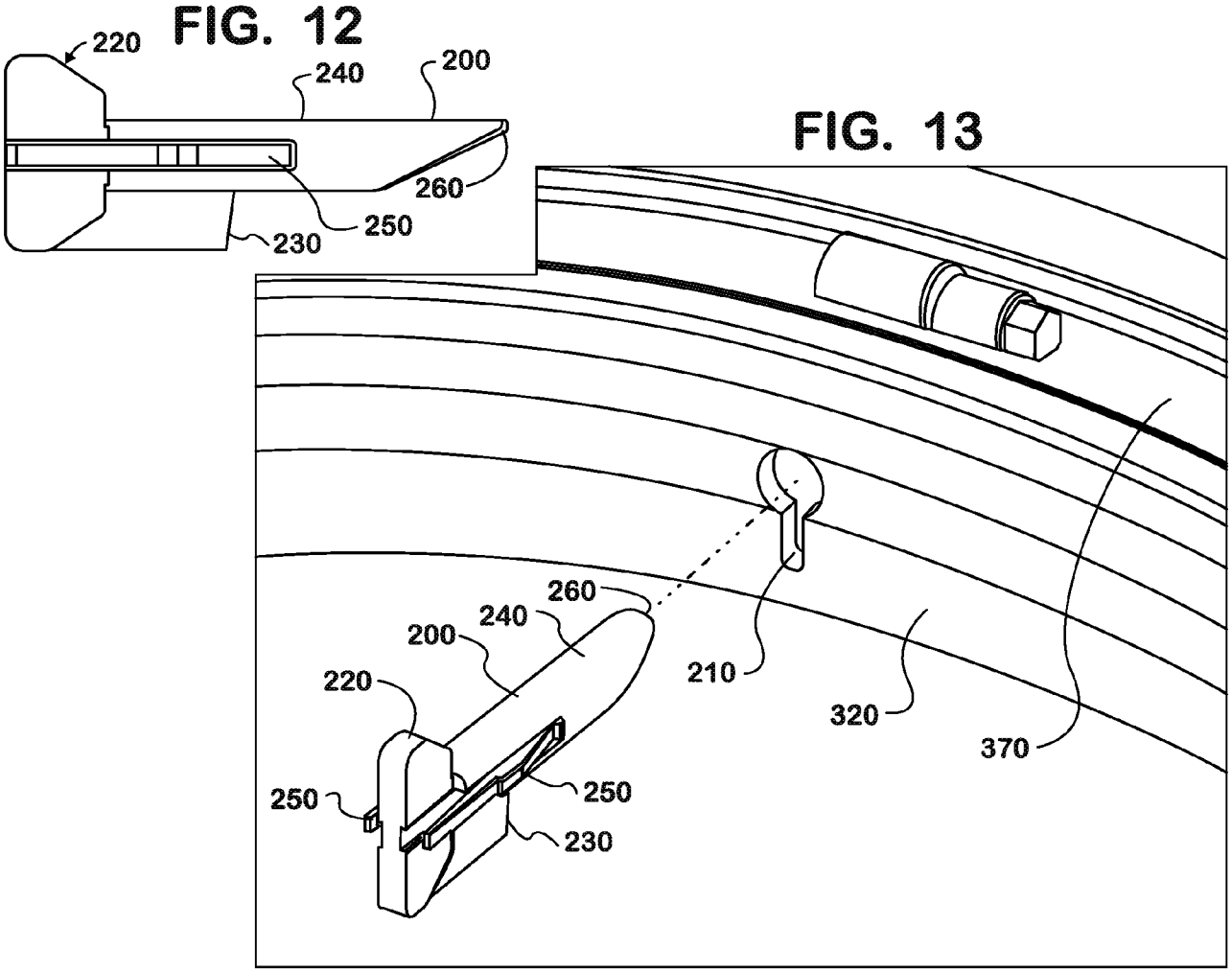
FIG. 12 shows a perspective view of the gap tool.
FIG. 13 shows an exploded view of gap tool and ring shroud with keyhole.
Figure 14:
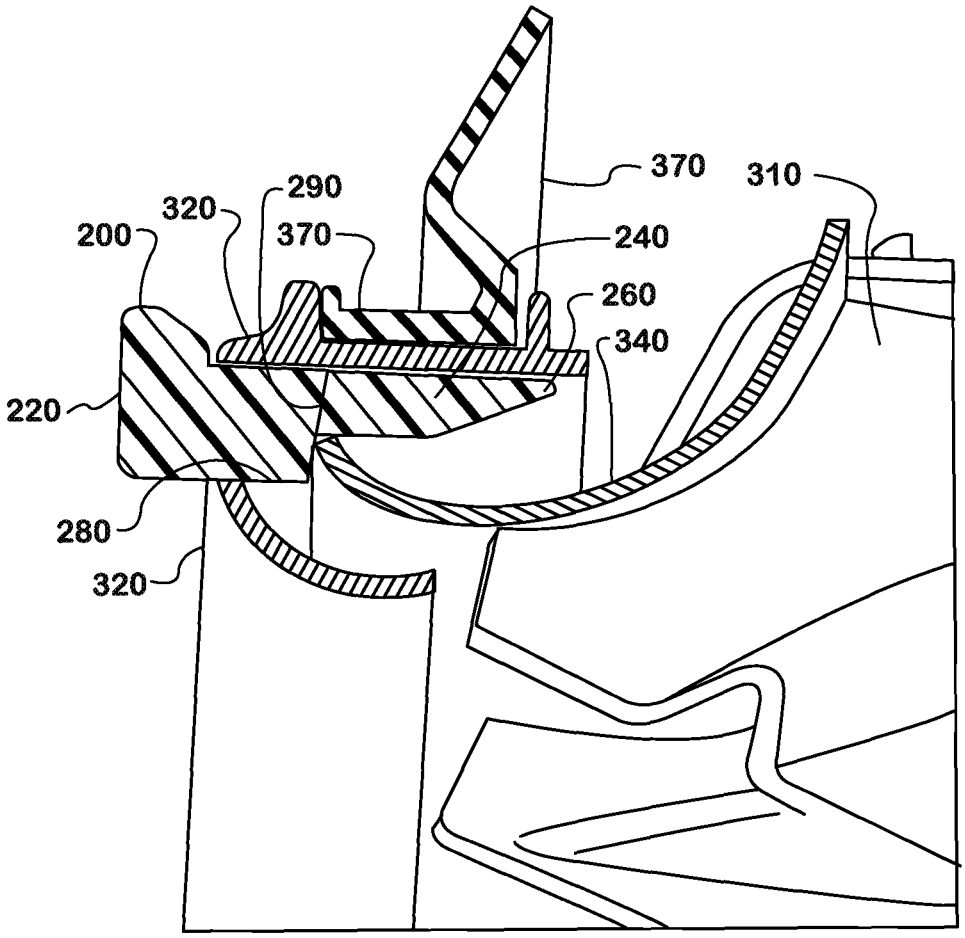
FIG. 14 shows a cross-sectional view of the gap tool, ring shroud, fan vane and fan rubber seal.

FIG. 13 shows that while the mounting brackets 410 are fastened in the engine 100 end and loose in the ring shroud 320 end, a plurality of gap tools 200 are inserted through perforated holes 210 in the ring shroud 320. FIG. 14 shows a cross-sectional view of the gap tool 200 being used to create a static condition during assembly and align the interior of the ring shroud 320 to the exterior fan outer ring 340. The shoulder stop 230 of the gap tool 200 sets the axial distance or clearance 280 between the interior of the ring shroud 320 and the exterior of the fan outer ring 340. The elongated cylinder 240 body of the gap tool 200 serves to set the radial distance or clearance 290 between the interior of the ring shroud 320 and the exterior of the fan outer ring 340.

Figures 15, 16:
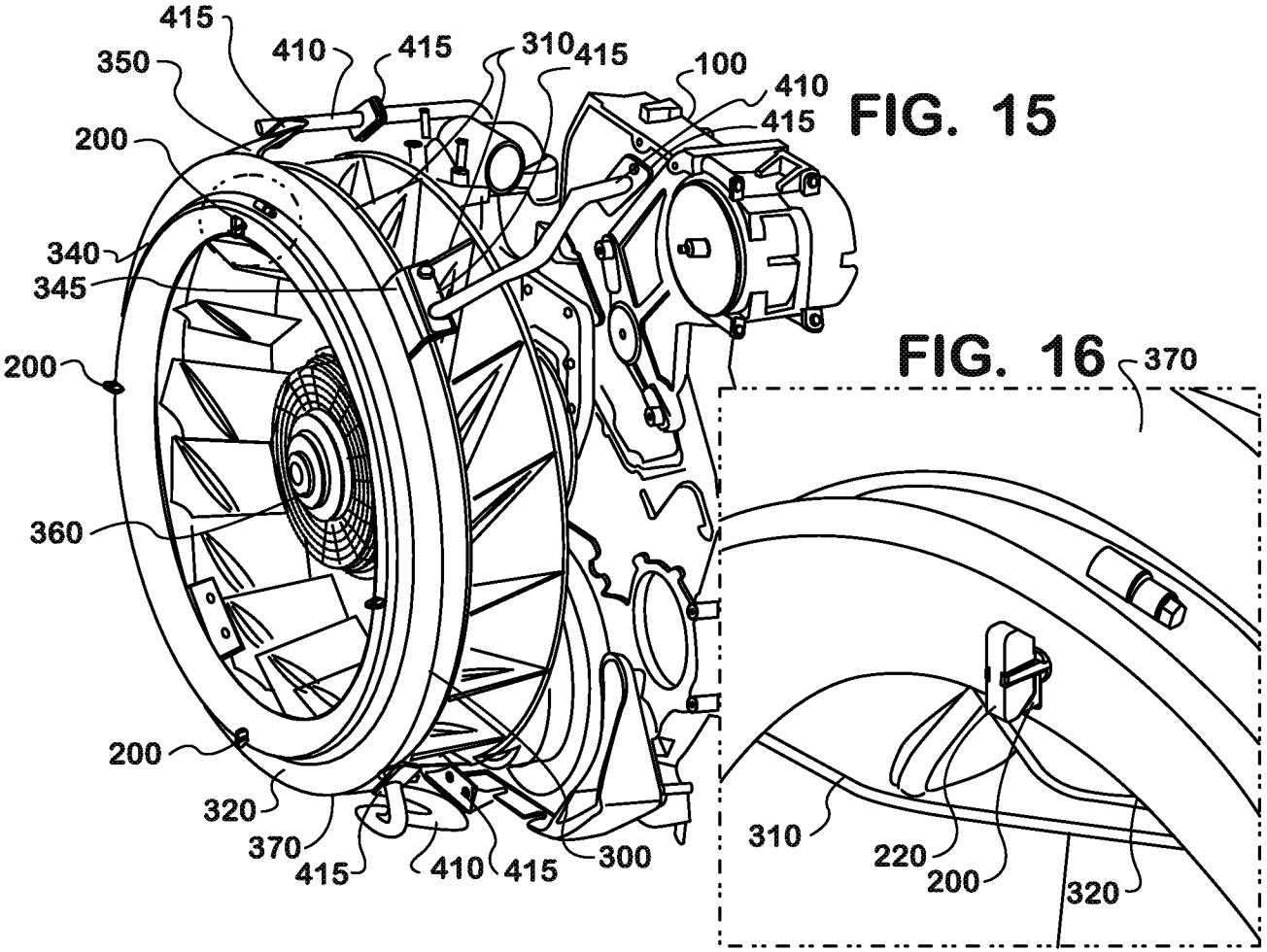
FIG. 15 shows a perspective view of partially assembled ring shroud, high efficiency hybrid fan, 15 L engine and mounting brackets and gap tool.
FIG. 16 shows a close up view of inserted gap tool in ring shroud.

FIG. 15 shows the engine 100, the cooling fan 300 assembly with four engaged gap tools 200 (only the head 220 portion and the outside portion of the resilient arms 250 can be seen) about ninety degrees from each other. FIG. 16 shows a segment of the ring shroud 320, the fan rubber seal 370, the fan vanes 310, the head 220 and the tip of two resilient arms 250 of the gap tool 200. In order to release the gap tool 200 from the ring shroud 320 and cooling fan 300 assembly, the resilient arms 250 may be squeezed together by manually exerting pressure on both sides inward towards the head 220.

Figure 17:
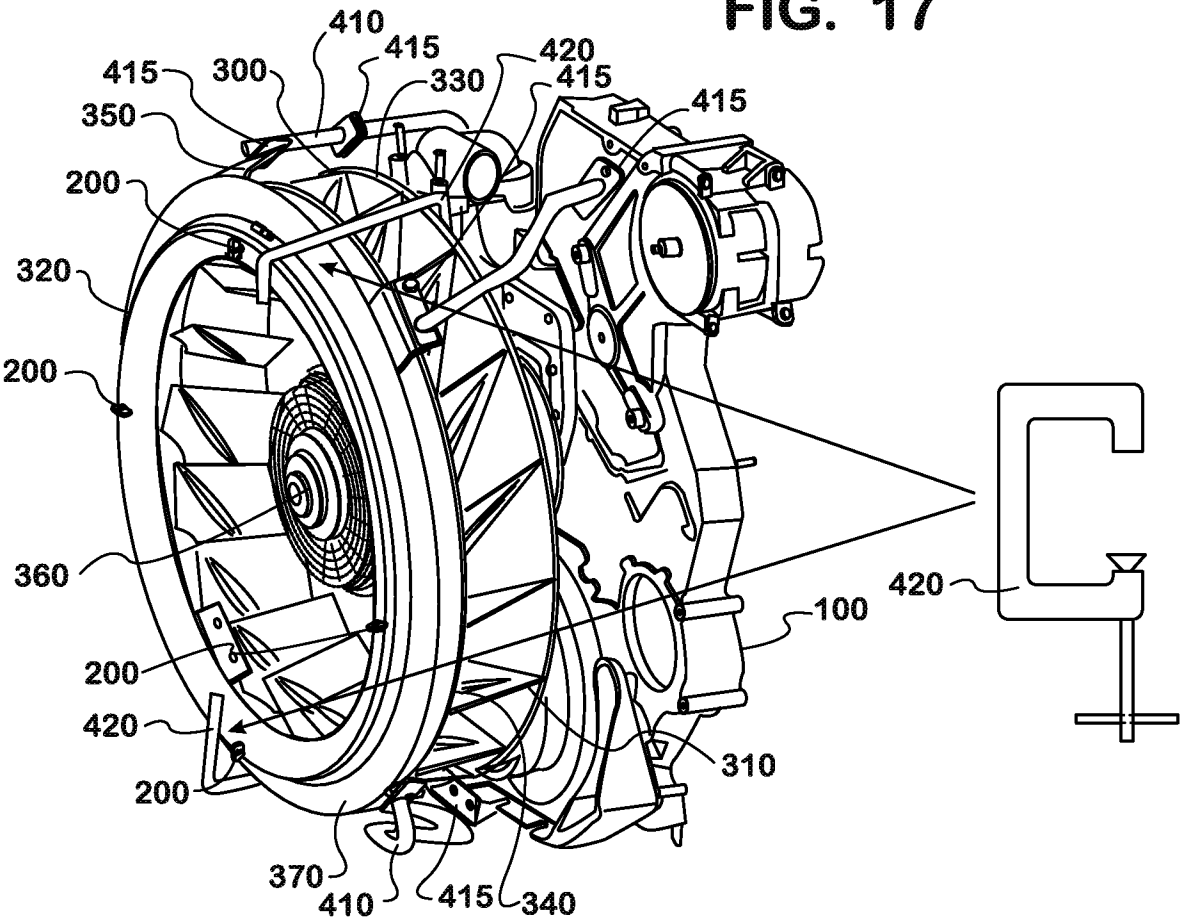
FIG. 17 shows a perspective view of the partially assembled ring shroud, high efficiency hybrid fan, 15 L engine, mounting brackets, gap tools and clamping devices.

FIG. 17 shows the engine 100, the cooling fan 300 assembly with four engaged gap tools 200 (only the head 220 portion and the outside portion of the resilient arms 250 can be seen) about ninety degrees from each other. FIG. 17 shows two commercially available clamping devices 420 clasping together the ring shroud 320, the fan rubber seal 370, and the cooling fan 300 including the fan circumferential ring 330 in the rear of the cooling fan 300 assembly. Although FIG. 17 suggests the use of only two clamping devices, the described method of assembly can use more than two clamping devices 420.

Once the gap tool 200 has facilitated the positioning of the ring shroud 320 over the cooling fan 300 assembly then the assembly operator (not shown) either manually or through automation will tighten the remaining loose fasteners 415 whereby securing the ring shroud 320 and cooling fan 300 assembly. After the fasteners 415 are tightened on all mounting brackets 410, the gap tools 200 may be removed manually or through automation means by urging the resilient arms 250 together with enough force to allow the gap tool 200 to once again fit through the ring shroud aperture 210 and be completely retrieved.

Figure 18:
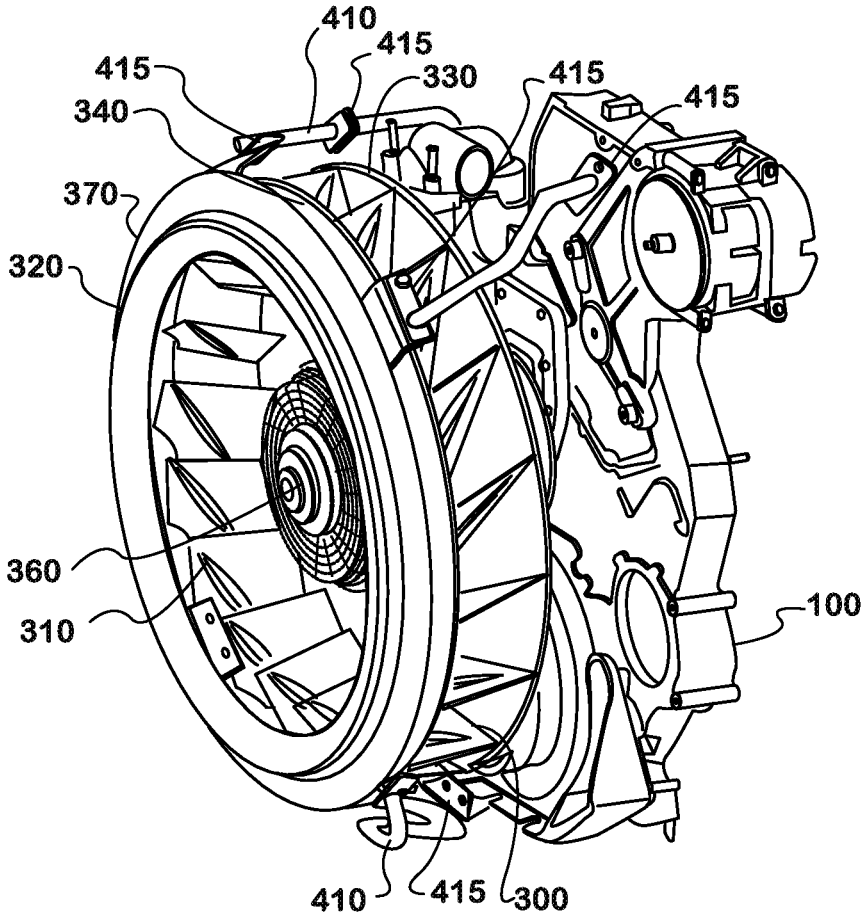
FIG. 18 shows a perspective view of an assembled high efficiency hybrid fan and 15 liter engine.

FIG. 18 shows the finished ring shroud 320 and cooling fan 300 assembly mounted on an engine 100.

Although the assembly method described utilizes mounting brackets with fasteners, the same outcome can be achieved with alternative mounting means while using the embodiment of the mounting gap tool 200 described. In place of mounting brackets with fasteners, the operator may use adhesive methods such as an epoxy adhesive for securing a ring shroud to a cooling assembly after the gap tools have been inserted to set the clearance between the subassembly components.

What is claimed is:

1. A fan assembly and gap tool for motor vehicle cooling system comprising:

an engine;

a fan motor;

a cooling fan;

at least three mounting brackets;

a ring shroud;

at least three fan braces;

wherein the fan motor is mounted to the engine, the cooling fan is mounted to the fan motor, each of the at least three fan braces is affixed to the ring shroud;

each of the at least three mounting brackets having one end and an opposite end with each of the at least three mounting brackets being mounted to the engine at the one end and loosely mounted to one of the at least three fan braces at the opposite end; and a plurality of gap tools for aligning the ring shroud to the cooling fan before securing the at least three mounting brackets to the at least three fan braces, wherein each of the plurality of gap tools comprises:

a head;

an elongated cylinder, having one end and an opposite end:

a shoulder stop, and:

at least one resilient arm;

the head being connected to one end of the elongated cylinder, the elongated cylinder having a beveled finish at the opposite end, the shoulder stop being connected to the elongated cylinder in a planar configuration with the head, and the resilient arm being attached to the elongated cylinder and gradually and continuously diverging outwardly from the opposite end of the elongated cylinder, wherein the shoulder stop sets an axial gap between the ring shroud and the cooling fan.

2. The fan assembly and gap tool of claim 1, wherein the cooling fan comprises a fan hub;

a plurality of fan vanes;

a fan circumferential ring; and a fan outer ring, wherein the plurality of fan vanes extend outwardly from the fan hub, the fan circumferential ring encircles the fan hub, and the fan outer ring has an annular shape and is attached to the plurality of fan vanes.

3. The fan assembly and gap tool of claim 1, wherein the elongated cylinder sets a radial gap between the ring shroud and the cooling fan.

4. The fan assembly and gap tool of claim 1, further comprising: two or more resilient arms wherein the resilient arms are attached to the elongated cylinder and gradually and continuously diverge outwardly from the opposite end of the elongated cylinder.

5. The fan assembly and gap tool of claim 1, wherein the two or more resilient arms are sufficiently resilient to be urged together during gap tool positioning through and retrieval from a ring shroud aperture.

6. The fan assembly and gap tool of claim 1, wherein the two or more resilient arms are sufficiently resilient so that the two or more resilient arms can return to a deployed configuration securing the plurality of gap tools in place after positioning through at least three ring shroud apertures.

7. The fan assembly and gap tool of claim 1, wherein the gap tool is made from at least one of thermoset polymer, thermoplastic polymer, metal and wood.

8. The fan assembly and gap tool of claim 1, wherein the gap tool is extruded.

9. The fan assembly and gap tool of claim 1, wherein the gap tool is cast.

10. The fan assembly and gap tool of claim 1, wherein the gap tool is injection molded.

11. A fan assembly and gap tool for motor vehicle cooling system comprising:

an engine;

a fan motor;

a cooling fan;

at least three mounting brackets;

a ring shroud;

at least three fan braces;

wherein the fan motor is mounted to the engine, the cooling fan is mounted to the fan motor, each of the at least three fan braces is affixed to the ring shroud;

each of the at least three mounting brackets having one end and an opposite end with each of the at least three mounting brackets being mounted to the engine at the one end and loosely mounted to one of the at least three fan braces at the opposite end; and a plurality of gap tools for aligning the ring shroud to the cooling fan before securing the at least three mounting brackets to the at least three fan braces, wherein the cooling fan, the at least three mounting brackets and the ring shroud are clasped together by a clamping device.

* * * * *